United States Patent [19]

Anderson

[11] Patent Number: 4,972,689

[45] Date of Patent: Nov. 27, 1990

[54] LOCKING SYSTEM

[76] Inventor: Edmund Anderson, 11 Barterholm Rd., Paisley, Renfrewshire, Scotland

[21] Appl. No.: 370,633

[22] Filed: Jun. 23, 1989

Related U.S. Application Data

[63] Continuation-in-part of Ser. No. 162,058, Feb. 29, 1988, abandoned.

[30] Foreign Application Priority Data

Feb. 28, 1987 [GB] United Kingdom ..... 8704757
Oct. 10, 1987 [GB] United Kingdom ..... 8723830

[51] Int. Cl.[5] ..... E05B 67/38
[52] U.S. Cl. ..... 70/56; 70/417
[58] Field of Search ..... 70/54–56, 70/416–418; 292/281

[56] References Cited

U.S. PATENT DOCUMENTS 3,718,014 2/1973 Delgadillo ..... 70/56
3,736,016 5/1973 Garvey ..... 292/281
4,535,612 8/1985 Seremet ..... 70/56

*Primary Examiner*—Robert L. Wolfe
*Attorney, Agent, or Firm*—Ratner & Prestia

[57] ABSTRACT

A locking system for locking together a first member and a second member which are relatively movable. The system has a first locking element, such as a staple, fixable on the first member and a second locking element, such as a hasp assembly, fixable on the second member, and locking means interengaging and locking said elements, which elements and the locking means when so locking said elements are protected by a cover comprising the hasp assembly. In another embodiment, the locking elements are in the form of apertured projections, interengaged by a shackle and locked by locking means, said shackle being provided with a cover.

2 Claims, 5 Drawing Sheets

LOCKING SYSTEM

This application is a continuation-in-part of U.S. Ser. No. 07/162,058, filed Feb. 29, 1988, now abandoned.

FIELD OF THE INVENTION

This invention relates to a locking system.

This invention especially relates to a locking system that protects the hinged links or shackles of padlocks.

BACKGROUND OF THE INVENTION

The doors of outhouses, garden sheds and the like are frequently locked with padlocks, yet the exposed links and shackles of these locks are particularly vulnerable to attack with pliers, saws and the like, and the property thus laid open to would-be thieves and vandals.

BRIEF SUMMARY OF THE INVENTION

According to the present invention there is provided a locking system for locking a first member and a second member, said members being relatively movable, comprising:

a first locking element fixable on said first member, the first locking element being a staple in the form of a projection with a thorough-aperture;

a second locking element fixable on said second member, the second locking element being a staple in the form of a projection with a through-aperture;

locking means comprising a shackle and a keeper for locking together said first and second locking elements when said elements are in juxtaposition, the said first and second locking elements being interengagable by the said shackle and lockable by said keeper;

a removable actuator for said locking means;

a close-fitting cover included on the shackle, the cover being for said locking means when said means is locking said elements together;

a recess in said cover for receiving said keeper so that said locking means is substantially encased in the cover;

and access means in said cover for permitting access by said removable actuator to the locking means.

The first member may be a door jamb, whereas the second member may be hingedly mounted and in the form of either a door panel or bar or extended hinge plate.

The locking means may be in the form of a padlock with detachable shackle.

Preferably, said recess for receiving the keeper and said access means for the actuator of the locking means have an opening in common.

BRIEF DESCRIPTION OF THE DRAWINGS

Embodiments of the present invention will now be described, by way of example, with reference to the accompanying drawings, in which.

DETAILED DESCRIPTION OF PREFERRED EMBODIMENTS

Figure 1:
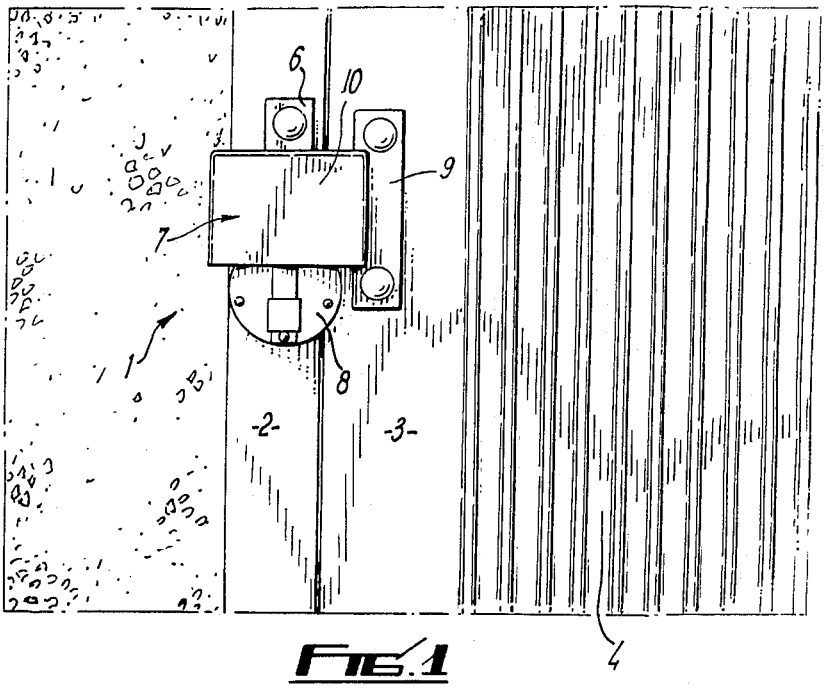
FIG. 1 is a front view in elevation of one embodiment of a locking system according to the present invention, in use in the locking system's engaged position.
Figure 2:
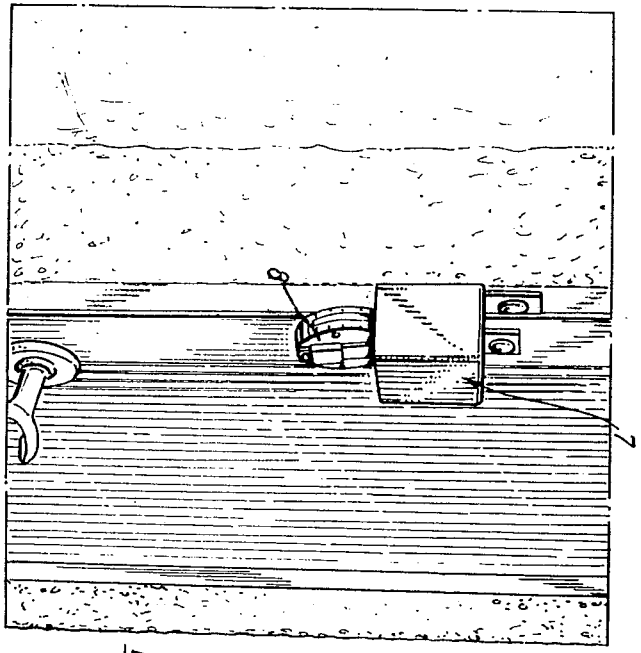
FIG. 2 is a perspective view from the left of the locking system of FIG. 1.
Figure 3:
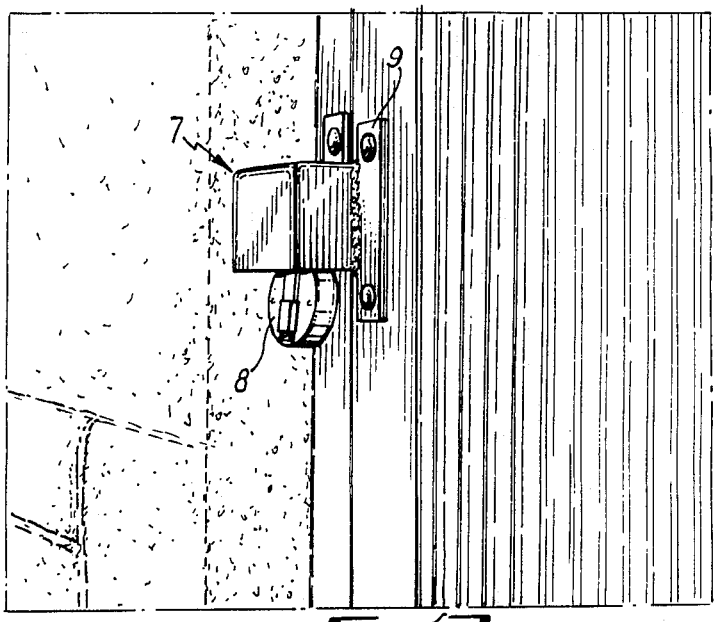
FIG. 3 is a perspective view from the right of the locking system of FIGS. 1 and 2.
Figure 4:
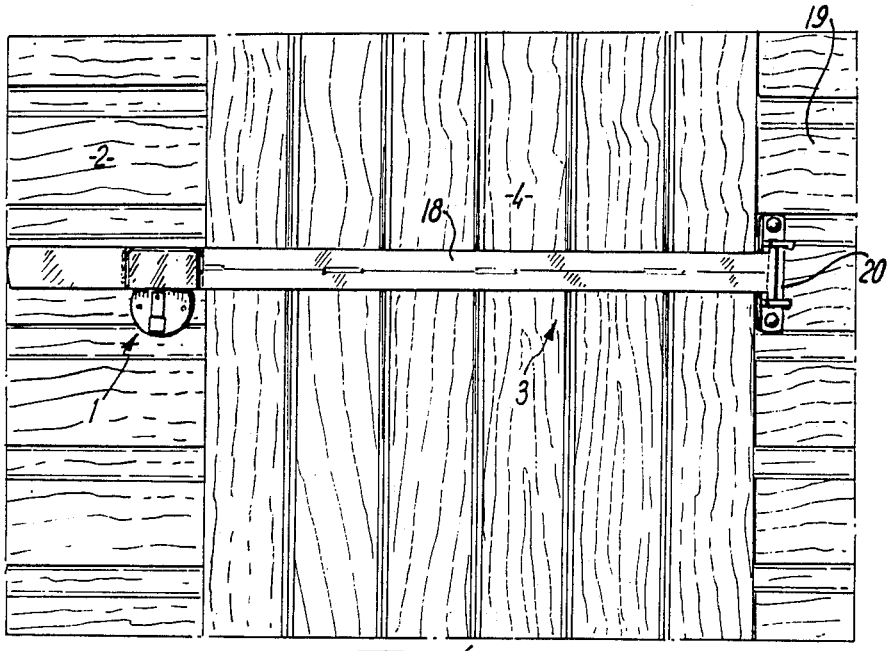
FIG. 4 is a front view in elevation of an alternative embodiment of a locking system according to the present invention, in use in the locking system's engaged position.
Figure 5:
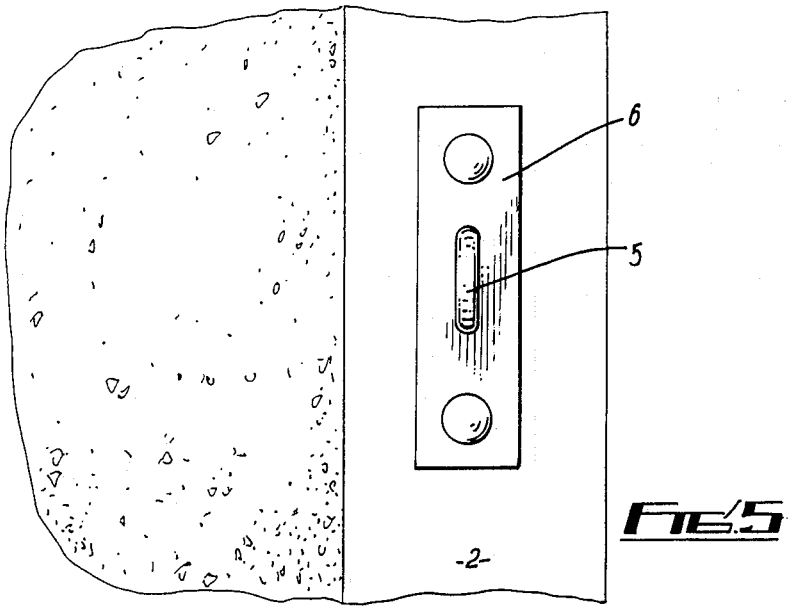
FIG. 5 is a front view in elevation of a staple means of FIGS. 1 to 4.
Figure 6:
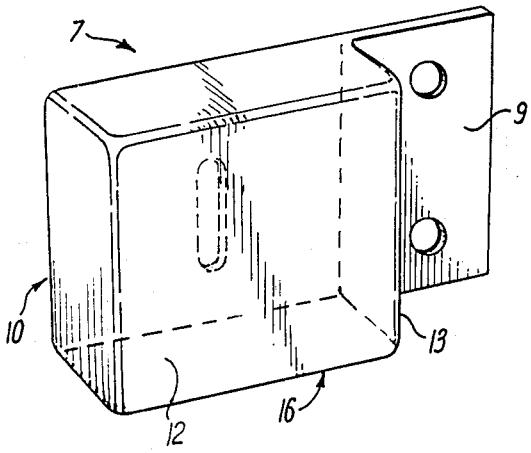
FIG. 6 is a perspective front view of a hasp assembly according to the present invention.
Figure 7:
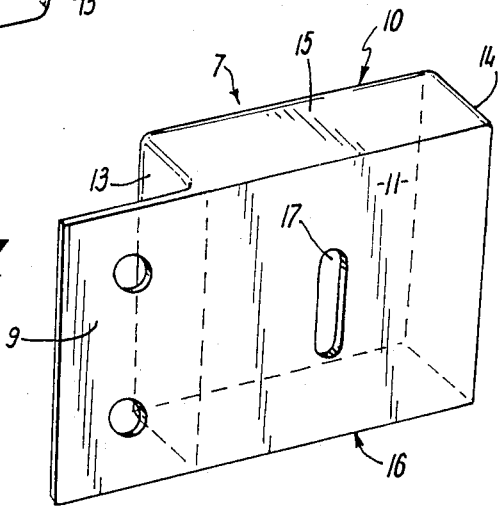
FIG. 7 is a perspective rear view of the hasp assembly of FIG. 6.

Referring to FIGS. 1 to 7 the drawings, there is provided a locking system 1 for a first member which is in the form of a nearside door jamb 2 and a second member 3 which is hingedly mounted and in one embodiment in the form of a door panel 4 (see FIGS. 1 to 3). The door jamb 2 is provided with a first locking element in the form of a staple 5 mounted on a support 6, whereas the hingedly mounted second member 3 is provided with a second locking element in the form of a hasp assembly 7 which, on juxtaposition of the two members 2, 3, engages with the staple 5 and is lockable in this engaged position by means of a padlock 8. The hasp assembly 7 comprising a fixing plate 9 for attachment to the hingedly mounted second member 3 and box-like cover 10 to protect the staple 5 and padlock 3, the cover 10 having an apertured back plate in the form of a hasp 11, a solid front plate 12, side plates 13, 14, a welded top plate 15, and open bottom 16.

Figure 8:
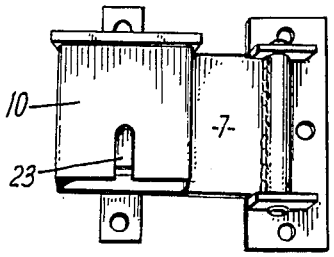
FIGS. 8 to 10 are front views of alternative embodiments of a locking system according to present invention, each in the locking systems unengaged state; and, FIG. 11 is a perspective part-exploded front view of an alternative embodiment of the locking means of this invention.
Figure 8:
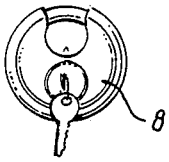
Figure 9:
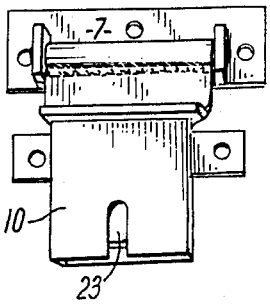
Figure 10:
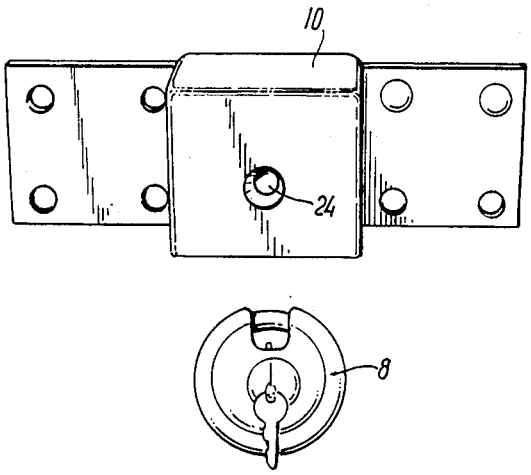

The hasp assembly 7 and staple 5 are engaged by closure of the hingedly mounted second member 3 causing the staple 5 to project through the aperture 17 of the hasp 11 into the interior space of the cover 10. The shackle 21 of the padlock 8 may then be passed into the open bottom 16 of the cover 10, threaded through the staple 5 and snapped into engagement with the keeper 22 of the padlock 8, and, owing to the protection afforded by the front, side and top plates 12, 13, 14, 15, the hasp 11, staple 5 and shackle 21 of the padlock 8 are protected from an attack by pliers, hack saws or the like, but the keyhole of the padlock 8 remains free for legitimate unlocking. In the embodiment of FIGS. 8 to 10, the hasp assembly 7 is extended to cover the entire keeper 22 with the keyhole of the padlock only accessible through a slot 23 or aperture 24 in the front plate 12. The padlock of these embodiments is such that the keeper 23 of the padlock 8 need not be turned or twisted for the shackle 21 to pass through the staple 5. The cover 10 therefore need not allow excess room for keeper manoeuvrability.

The hasp 11 and staple 5 are engaged on closure of the second member 3, and the operation of the locking system 1 in the embodiments of FIGS. 1 to 3 and FIG. 10 rely on the existing hinges of the second member 3; the fixing plate 9 and the box-like cover 10 are therefore joined firmly and unhingedly and their junction does not provide a weak point for removal of the locking system 1.

To increase the strength of the locking system 1 still further by, in certain instances, protecting a flimsy door panel 4 or supplementing or protecting the weak existing door hinges, the hasp assembly 7 can be affixed to the free end of a hingedly mounted second member 3 that is in the form of an extended hinge plate 18 which reaches from the far side door jamb 19 across the width of the door panel 4, the hinge plate 18 either being that of an existing door hinge (not shown) or that of a supplementary hingedly mounted unit 20 (see FIG. 4) wherein the plate 18 may or may not be attached to the door panel 4.

Figure 11:
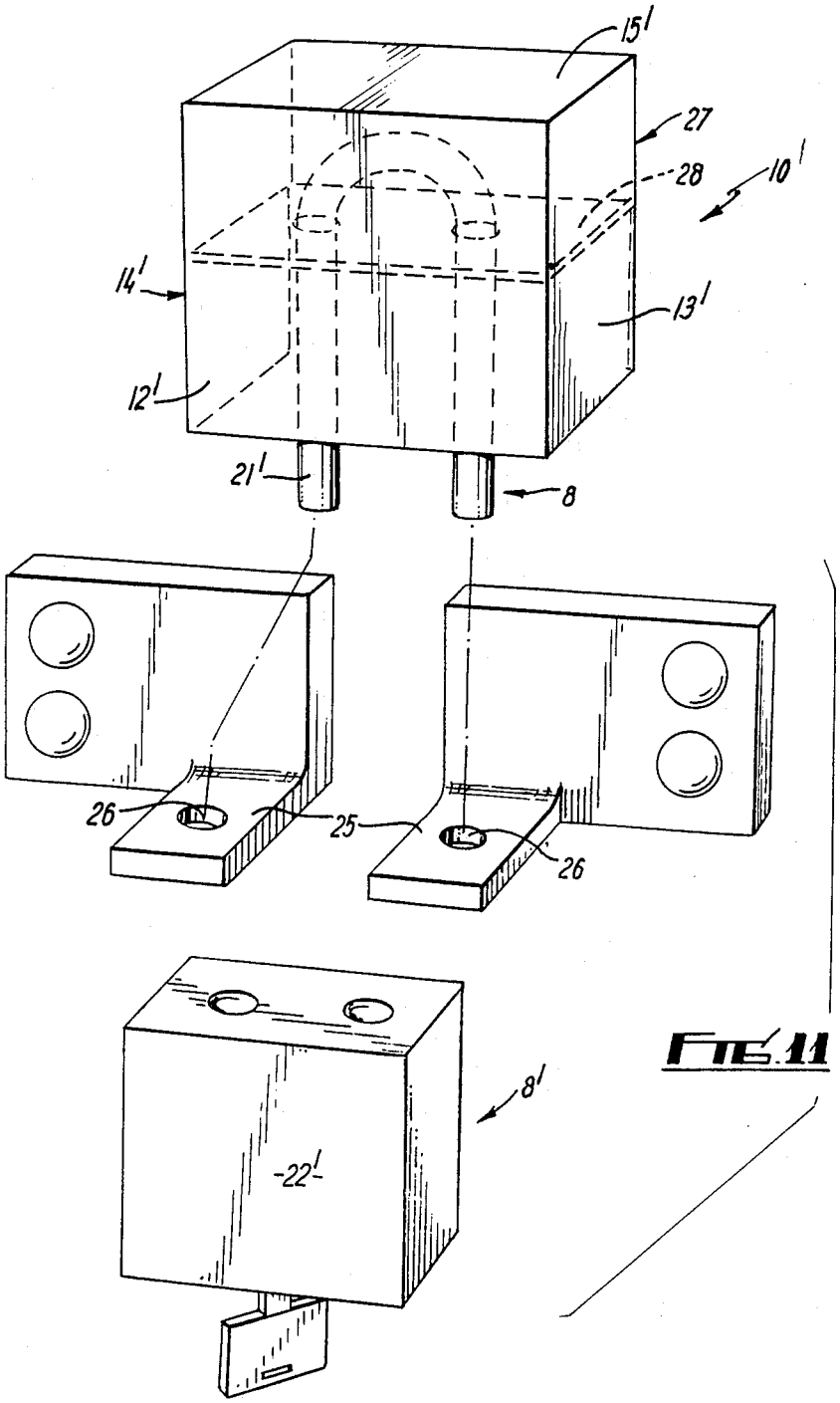

Referring now to FIG. 11 of the drawings, the first and second locking elements are in the form of projections 25 with through-apertures 26. The projections 25 are juxtaposed on closure of, for example, a door to which one element is attached, and are interengaged by the shackle 21' of a padlock 8', the shackle 21' being provided with a cover 10' resembling that of the above-mentioned hasp assembly 7. The cover 10' comprises front, sides and top plates 12', 13', 14', 15' and an infill upper portion providing a partical back plate 27 and a cross plate 28 to restrain the shackle 21'. The keeper 22' of a padlock 8' locks the system in place by receiving the downwardly projecting shackle extensions. The padlock 8 of this embodiment is such that the shackle 21' is fully removable from the keeper 22'; the position of the keyhole may vary however.

Modifications and improvements may be incorporated without departing from the scope of the invention.

I claim:

1. A locking system for locking a first member and a second member, said members being relatively movable, comprising:

a. a first locking element fixable on said first member, the first locking element being a staple in the form of a projection with a through-aperture;

b. a second locking element fixable on said second member, the second locking element being a staple in the form of a projection with a through-aperture;

c. locking means comprising a shackle and a keeper for locking together said first and second locking elements when said elements are in juxtaposition, the said first and second locking elements being interengagable by the said shackle and lockable by said keeper;

d. a removable actuator for said locking means;

e. a close-fitting cover comprising front, side, and top plates and an infill upper portion providing a partial back plate and a cross plate included on the shackle, the cover being for said locking means when said means is locking said elements together;

f. a recess in said cover for receiving said keeper so that said locking means is substantially encased in the cover; and g. access means in said cover for permitting access by said removable actuator to the locking means.

2. A locking system as claimed in claim 1, wherein said recess for receiving said keeper and said access means for the actuator of the locking means having an opening in common.

* * * * *